US008465334B2

(12) United States Patent
Hort et al.

(10) Patent No.: US 8,465,334 B2
(45) Date of Patent: Jun. 18, 2013

(54) FIN BOX

(75) Inventors: Michael John Hort, Chatswood (AU); Eric John Wolinski, One Mile Beach (AU); David John Russell Wood, Sydney (AU)

(73) Assignee: Origin Fin Systems Pty Ltd., Leichhardt (AU)

( * ) Notice: Subject to any disclaimer, the term of this patent is extended or adjusted under 35 U.S.C. 154(b) by 180 days.

(21) Appl. No.: 12/746,786

(22) PCT Filed: Dec. 15, 2008

(86) PCT No.: PCT/AU2008/001840

§ 371 (c)(1),
(2), (4) Date: Aug. 31, 2010

(87) PCT Pub. No.: WO2009/076706

PCT Pub. Date: Jun. 25, 2009

(65) Prior Publication Data

US 2011/0039463 A1 Feb. 17, 2011

(30) Foreign Application Priority Data

Dec. 14, 2007 (AU) ..... 2007906773
Apr. 1, 2008 (AU) ..... 2008901566

(51) Int. Cl.
*B63B 1/00* (2006.01)
*B63B 35/00* (2006.01)

(52) U.S. Cl.
USPC ..... 441/79

(58) Field of Classification Search
USPC ..... 441/65, 74, 79; 114/278
See application file for complete search history.

(56) References Cited

U.S. PATENT DOCUMENTS

| | | | | |
|---|---|---|---|---|
| 3,516,099 | A | 6/1970 | Morey et al. | |
| 4,325,154 | A | 4/1982 | Collum | |
| 4,804,347 | A | 2/1989 | Ross | |
| 5,176,096 | A | 1/1993 | Molnar et al. | |
| 5,830,025 | A | 11/1998 | Fleming | |
| 5,934,962 | A | 8/1999 | Daum et al. | |
| 6,386,933 | B1 | 5/2002 | Rewald et al. | |
| 6,793,548 | B2 * | 9/2004 | Jolly et al. | 441/79 |
| 6,821,173 | B2 | 11/2004 | McAusland et al. | |
| 6,896,570 | B1 | 5/2005 | O'Keefe et al. | |
| 7,497,752 | B2 * | 3/2009 | Field | 441/79 |
| 2007/0218788 | A1 | 9/2007 | Field | |

FOREIGN PATENT DOCUMENTS

| | | | |
|---|---|---|---|
| DE | 2826117 | A | 12/1979 |
| DE | 3634445 | A1 | 4/1988 |
| EP | 0 079 113 | A1 | 5/1983 |

(Continued)

OTHER PUBLICATIONS

International Search Report for Int'l Patent Appln. No. PCT/AU2008/001840 dated Mar. 20, 2009.

*Primary Examiner* — Daniel Venne
(74) *Attorney, Agent, or Firm* — Carter, DeLuca, Farrell & Schmidt LLP

(57) ABSTRACT

The present invention relates to a fin box adapted to be fitted to a watercraft and to receive a fin having a base. The fin box includes an elongate receiving portion having a length. The base is adapted to be inserted into the receiving portion substantially laterally. The fin during insertion into the receiving portion is disposed at a lower than 90 degree angle to the receiving portion.

24 Claims, 20 Drawing Sheets

FOREIGN PATENT DOCUMENTS

| | | | |
|---|---|---|---|
| JP | 2006-82607 | A | 3/2006 |
| JP | 2007-22408 | A | 2/2007 |
| WO | WO 91/17080 | A1 | 11/1991 |
| WO | WO 2007/049498 | A1 | 5/2007 |

* cited by examiner

FIN BOX

TECHNICAL FIELD

The present, invention relates broadly to watercraft and relates particularly though not exclusively to a fin box for surfboards.

BACKGROUND ART

Surfboards typically have either one large fin or three small fins. In the case of a single fin surfboard, the fin is usually fixed on the underside of the board towards its tail along the centre line. A three-fin surfboard usually includes a fin attached to the underside of the rear of the board on its centre line, and the other two side fins placed symmetrically towards the outside edges of the board. The two side fins are usually raked outwards by around 4 degrees compared to the centre fin.

Surfboard fins are either permanently fixed to a surfboard by means of fibreglass resin, or are removable, using a variety of fixing systems.

Fixed fins are generally stronger and stiffer than removable fins and are expected is to give better performance when surfing. Fixed fins are more expensive to install and replace if damaged. They are also more cumbersome to transport.

By contrast, removable fins are secured to a surfboard, generally via a fin box, which is typically permanently fixed to the surfboard by a polyester resin. Prior art removable fins have an inferior performance compared to fixed fins due to the less rigid mounting. However, removable fins are advantageous in that 1) they allow a surfer to choose a specific type of fin to suit his or her own style of surfing; 2) fins can be changed for different conditions and may easily be replaced if broken; and 3) the surfboard itself is less susceptible to damage than the fin. As such, when the fin breaks, it is not uncommon that the surfboard remains intact. Some fins in the marketplace such as those disclosed in U.S. Pat. No. 7,025,645 and U.S. Pat. No. 5,567,190 can be replaced and adjusted to suit different conditions for better performance but this requires complex re-positioning of the fin.

One of the main deficiencies of removable fins is the susceptibility of the fin box to flexing in the surfboard. This means that the fin is likely to move with the flexing box, thereby impairing the performance of the fin. To address this problem, some fin boxes in the marketplace are secured to the hard top face of the surfboard either by means of a screw fixing or an adhesive fixing to the inside face of the top surface.

The total weight of a surfboard is also critical. A surfboard should preferably be kept as light as possible. Generally speaking, the lighter the box and less resin used for installation in the board, the better the surfboard performs.

The ease of installation of the fin box into the surfboard is of critical importance to a fin system. If the fin box is too difficult or takes too long to install, it will not be welcomed by surfboard shapers. Ease and speed of installation are therefore believed to have a huge influence on the sale of surfboard fin systems.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed in Australia or elsewhere before the priority date of each claim of this application.

SUMMARY OF THE INVENTION

According to one aspect of the present invention there is provided a fin box adapted to be fitted to a watercraft and to receive a fin having a base, the fin box including an elongate receiving portion having a length, the base being adapted to be inserted into the receiving portion substantially laterally, the fin during insertion into the receiving portion being disposed at a lower than 90 degree angle to the receiving portion.

Preferably, the receiving portion is longer than the base which is movable in use between two or more positions with respect to the receiving portion.

Preferably, the fin box includes one or more retaining means adapted to retain the fin within the fin box. More preferably, the retaining means includes at least one protrusion adapted to engage at least part of the base. The protrusion may take the form of an elongate bar. The retaining means may be located in proximity to an upper edge of the receiving portion, thereby allowing the receiving portion to have a minimal depth.

The base of the fin is preferred to be shaped so as to facilitate insertion thereof into the receiving portion substantially from one side thereof. The base preferably has at least one slot on each of the opposing sides. At least a portion of each slot on each side may be adapted to engage the protrusion. More preferably, there are two slots on each of the opposing sides, the two slots being divided by a section. Even more preferably, the retaining means also include at least one impediment on each side of the base, the impediment being adapted to in use engage the section so as to prevent the fin from sliding longitudinally. Another portion of each slot is preferred to include an engagement means adapted to in use be engaged by one or more securing means. The securing means may be movably connectable to the receiving portion, the securing means adapted to lock the fin in one of the positions.

In one embodiment, the base includes one or more, engagement means forming part of one or more of the slots, respectively. It is preferred that the or each engagement means is a shoulder to which the securing means in use abut. Preferably the shoulder is tilted towards the securing means to facilitate abutment.

Optionally, the engagement means is connected to the base via a frangible element or an area of weakness adapted to fracture or shear at a predetermined load, for example when the fin hits a rock, thereby enabling the fin to break away from the fin box. This is advantageous in that damage to the fin box and watercraft can be minimised in the event of an accident. The frangible element or area of weakness may be connected to or form an integral part of the base. In the most preferred embodiment, at least part of the engagement means, is made of or coated with a harder material than that of the base or fin.

In an alternative embodiment, the fin is adapted to be received in a single position within the fin box. In other words, the fin in such an embodiment is not movable within the fin box. Both the impediments on the fin box and the sections dividing the slots become superfluous and hence may be omitted. In this embodiment, the base includes one or more orifices into which engaging means in the form of tilted shoulders extend. Conveniently, the shoulders are tilted towards one another. Preferably, the securing means in the form of grub screws go through the respective through apertures angularly to abut the respective tilted shoulders.

In one embodiment, the securing means include one or more (preferably at least two) screws adapted to engage the base. The receiving portion may have or be associated with a through aperture for receipt of the, or each, securing means.

Each securing means is preferred to be configured so as to be at least partially movable from an unlocked position to a locked position for preventing any undesired movement of the fin. The securing means may include a biasing means such as a cam with a rotational axis, and a member which is rotatable about the axis to engage with a slot in the fin, so as to prevent undesired such as vertical movement of the fin when locked in place. The cam may be configured such that it is manually rotatable by a simple tool.

In a preferred embodiment, the securing means is configured to enable installation and removal of the fin with minimal tools.

In another embodiment, the securing means includes a flexible or rotatable arm with a head designed to in use engage with the slot in the fin, so as to prevent vertical movement of the fin when locked in place. A biasing means such as a cam or lever, may be included to enable movement of the arm with or without a tool.

Preferably the fin box is configured to have a minimal depth so as to enable placement thereof at or adjacent the rear of the watercraft.

In a preferred embodiment an external surface of the receiving portion comprises a framework so configured as to facilitate positive/interlocking engagement thereof with an adhesive material for affixing the fin box to the watercraft. Conveniently the external surface includes guiding means for directing flow of the resin throughout the receiving portion during installation. Preferably the guiding means include channels provided throughout the wall of the receiving portion to enable thorough penetration of the resin so as to encapsulate selected portions of the framework.

In one embodiment, a removable infill part is placed in the receiving portion of the fin box prior to the attachment of the removable lid. This infill may be shaped such that part or all of its upper surface corresponds with the depth to which the layer of resin covering the fin box is desired to be sanded during installation. The infill is preferably made of a hard material, such as ceramic, which does not easily get worn away by the abrasive used for sanding the surfboard. The infill is preferably reusable. The upper surface of the infill may be shaped so as to allow the surface of the surfboard to be easily sanded to a curved profile from front to rear of the fin box.

Preferably the fin box includes a removable lid adapted to seal the receiving portion. Optionally the lid has one or more fastening means for securing the lid to the fin box. The fastening means may include one or more of the following: a threaded fastener, a quarter turn fastener, or a press or clip fit mechanism.

Optionally the infill is releasably attached to the removable lid. Conveniently the lid is removable in its entirety during sanding.

It is preferred that the lid includes one or more indicators adapted to assist in providing an indication of a thickness of the lid.

The fin box may include a positioning means forming an integral part of or removably attachable to the lid. The positioning means is preferred to be a plate adapted to facilitate angular adjustment of the fin box with respect to the watercraft. The plate may be removably attachable to the lid by fastening means such as a threaded fastener, a quarter turn fastener, or a press or clip fit mechanism.

Optionally the infill is configured such that the positioning means is removably attachable to the lid by fastening means such as a threaded fastener, a quarter turn fastener, or a press or clip fit mechanism.

In another embodiment of the fin box of the present invention, the retaining means are in the form of protrusions and may include one or more lugs extending from a is wall of the receiving portion. Most preferably, one or more pairs of retaining means are provided. In a preferred embodiment, the base includes a flange with one or more legs. Preferably each of the legs has a foot adapted for engagement with one or each pair of retaining means.

In this embodiment the receiving portion may include a circumferential shoulder defining a recess for accommodating the one or more legs.

In this embodiment, each securing means is configured so as to be at least partially movable from a suppressed position to a released position for impeding longitudinal movement of the fin. The securing means may include a head portion and a pair of arms, each of the arms having a return for engagement with the receiving portion. Preferably the pair of arms are located intermediate the shoulder and the flange of the base. More preferably the shoulder includes or is connected to a pair of props on which the pair of arms rest, respectively. The securing means may be adapted to be biased by the props to the released position.

The head portion may be adapted to impede movement of the flange of the base when the securing means is in the released position thereby facilitating locking of the fin in the receiving portion in a predetermined position.

Conveniently the fin box includes two securing means, one located at each end. In a preferred embodiment, when in use, one securing mean is in a suppressed position while the other securing means is in the released position. Preferably suppression of one securing means from the released position to the suppressed position enables longitudinal movement of the fin along the receiving portion.

In this embodiment, the securing means includes a member adapted to be releasably fixed onto a predetermined location of the circumferential shoulder via a fixture. Conveniently the fixture includes a screw. Preferably the member when in use is configured to abut the flange of the base thereby impeding it from moving. In a preferred embodiment the member is in the form of a quarter-moon-shaped plate.

Preferably the fin box is affixed to the watercraft by an adhesive material. The adhesive material may be a resin. The fin box may include a dam for receipt of the adhesive material. Preferably the dam surrounds the fin box conforming to the shape thereof. The dam may be integral with the fin box. Conveniently the dam is connected to the fin box via a plurality of struts. Preferably the dam is at least partially removed such that the fin box is flush with the watercraft when in use. In this embodiment, the dam may be at least partially removed by sanding during installation of the fin box.

Conveniently the fin box includes one or more location indicators to facilitate accurate positioning thereof. Preferably the receiving portion is symmetrical in shape. Even more preferably the receiving portion is adapted to receive fins for different purposes. Typically the fins include both side and centre fins. Most preferably the receiving portion is capable of receiving various fins retrofitted with an adaptor. The adaptor may vary in size so as to fit onto fins of different shapes and sizes.

Preferably the base includes a curvedly diverging contour so as to provide an adjoining region with a smooth transition from the body of the fin to the surface of the watercraft.

Optionally an underside of the fin is cored out to reduce the weight of the fin.

The fin may have a hollow cavity, thereby allowing inclusion of a stiffening element for control of the lateral stiffness of the fin. The stiffening element may be removable and replaceable with an element of a different stiffness. The stiffening element may be adapted to vary in stiffness. The stiffness may be adjusted by varying parameters such as the cross section of, and/or the stress in, the stiffening element. The stiffening element may also be configured to vary in stiffness by altering the second moment of area of the stiffening element.

In a preferred embodiment the fin box is configured to enable installation and removal of the fin with minimal tools.

Optionally the fin box is adapted to be received in a cavity provided in the watercraft. The fin box is preferred to be elongate in shape having elliptical or arcuate ends. Most preferably the fin box is made of a light but stiff material such as glass or carbon fibre reinforced polymer.

The watercraft herein referred to includes a surfboard.

According to another aspect of the present invention there is provided a fin having a body and a base adapted to be contiguously adjoined to a surface of a watercraft when in use, the base having a streamlined profile so as to minimise resistance to a current of water.

According to a further aspect of the present invention there is provided a method of manufacturing a surfboard having a fin box, the method including some or all of the steps of:

(1) producing a surfboard blanks;
(2) providing a cavity to receive the fin box;
(3) inserting the fin box into the cavity;
(4) covering the fin box with a layer of resin; and
(5) sanding the layer of resin to be flush with the general surface of the surfboard.

Preferably the method includes one or more of the following steps:

(6) inserting the infill into the receiving portion of the fin box being inside the cavity;
(7) providing a lid for the fin box;
(8) removing the cover after sanding; and
(9) removing the infill.

BRIEF DESCRIPTION OF THE DRAWINGS

In order to achieve a better understanding of the nature of the present invention, certain preferred embodiments of a fin box will now be described by way of example only, with reference to the accompanying drawings in which.

BEST MODE OF CARRYING OUT THE INVENTION

For the ease of reference, common components in different embodiments of the present invention are given the same numeral.

Figure 1:
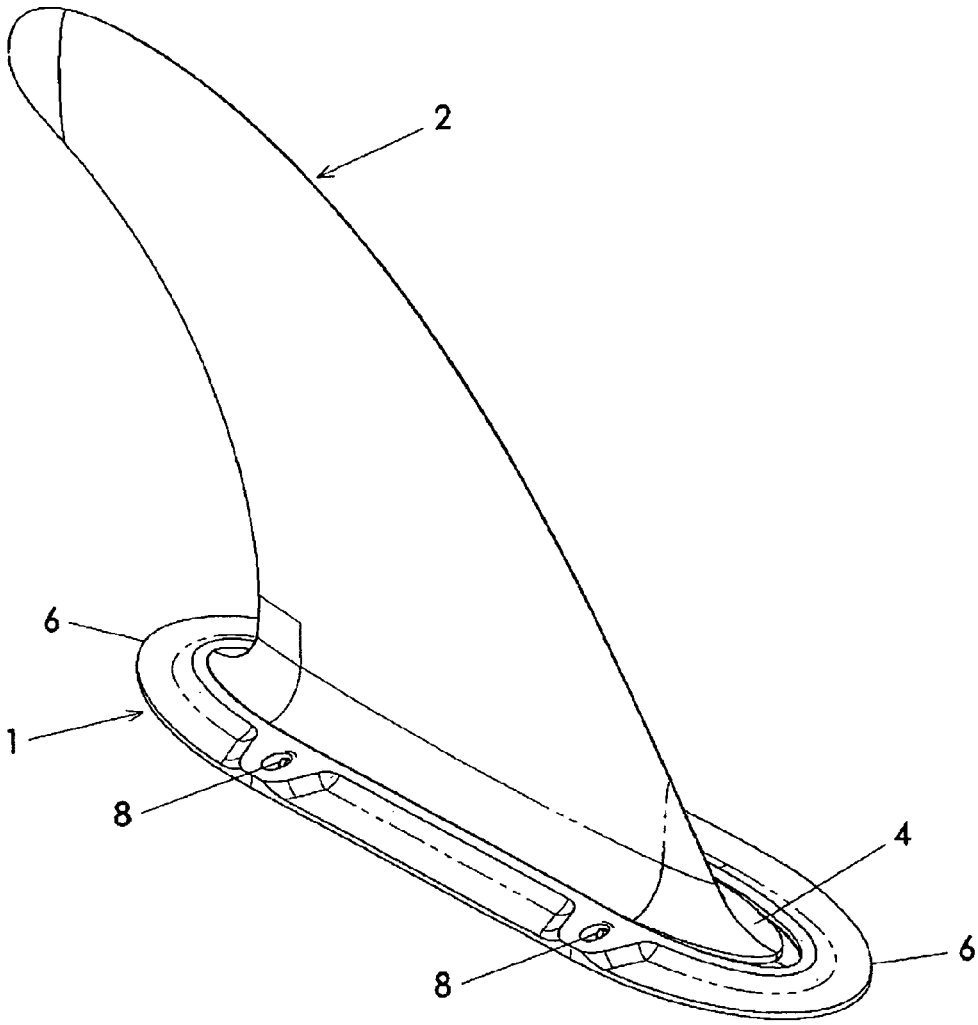
FIG. 1 is a perspective view of a fin box with a fin installed in a rear position in the fin box, in accordance with a preferred embodiment of the present invention.
Figure 2:
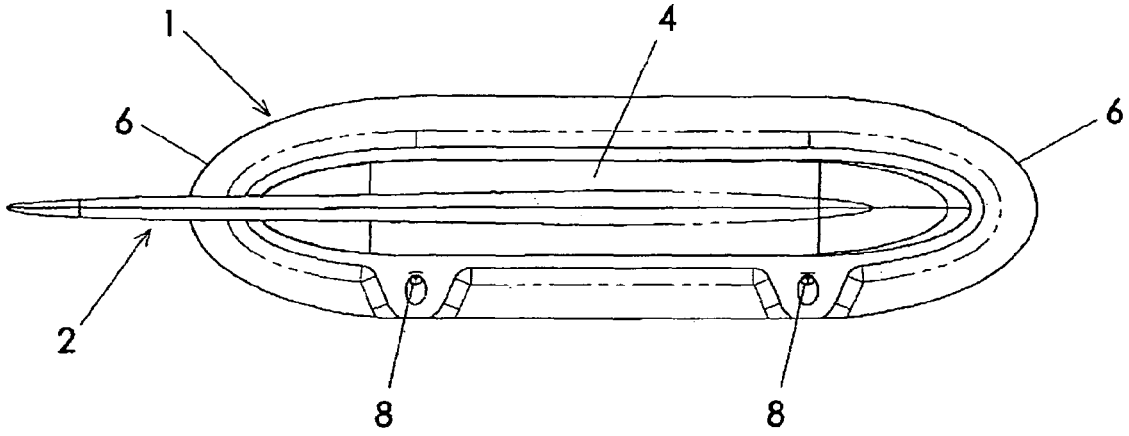
FIG. 2 is a top plan view of the embodiment of FIG. 1.
Figure 3:
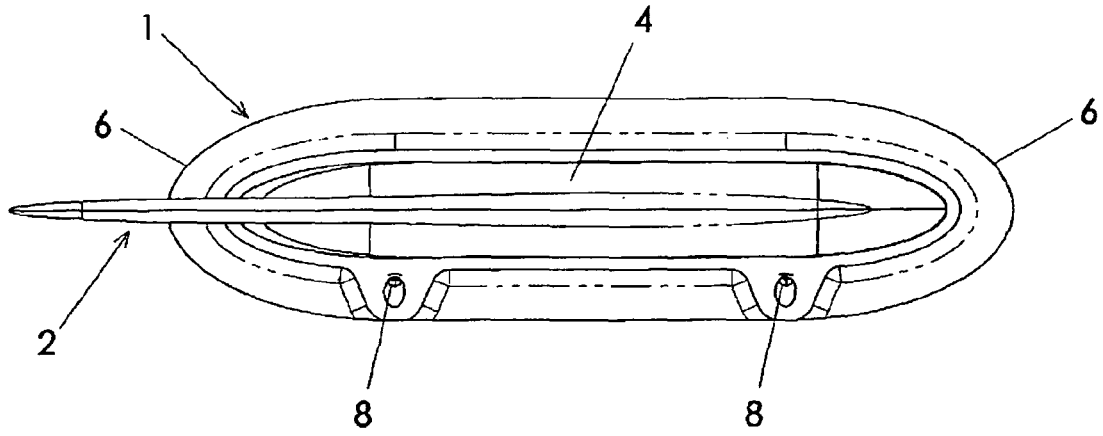
FIG. 3 is a top plan view of the fin box of FIG. 1 with the fin installed in a front position in the fin box.

As shown in FIGS. 1, 2 and 3, there is a fin box 1 being fitted to a watercraft such as to the deck of a surfboard (not shown). The fin box 1 is elongate in shape having elliptical ends 6. The fin box 1 in this embodiment is made of a stiff yet light material such as glass or carbon fibre reinforced polymer.

Figure 4:
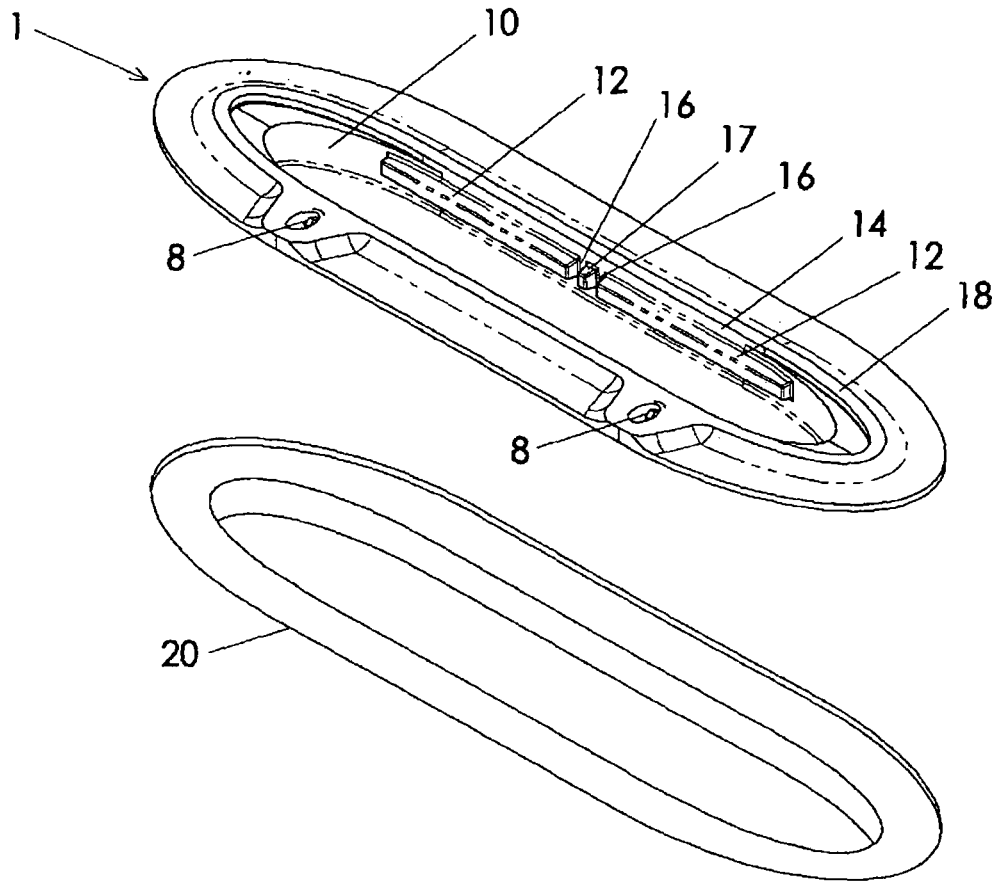
FIG. 4 is a perspective view of the fin box of FIG. 1 and a cavity in a watercraft, omitting the fin and showing the cavity in the surfboard.

Referring to FIG. 4, the fin 2 is received within the fin box 1 which in turn is received in a cavity 20 provided in the watercraft. The fin box 1 includes a receiving portion 10 and securing means 8. The receiving portion 10 is longer than a base 4 (refer back to FIGS. 1, 2 and 3) of the fin 2. The base 4 in the present embodiment is in the form of a flange. The securing means 8 are located on one side of the fin box 1. The securing means 8 are for locking the fin 2 in a chosen longitudinal position in the receiving portion 10.

Figure 5:
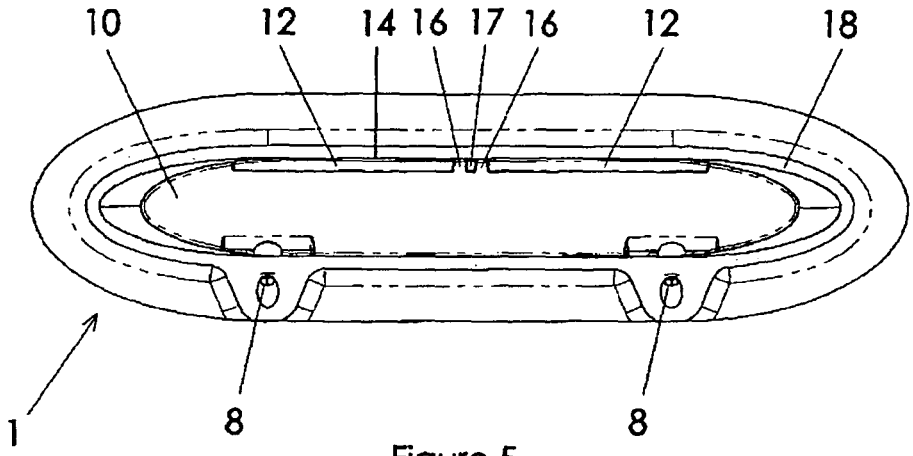
FIG. 5 is a top plan view of the fin box of FIG. 1, omitting the fin.
Figure 9:
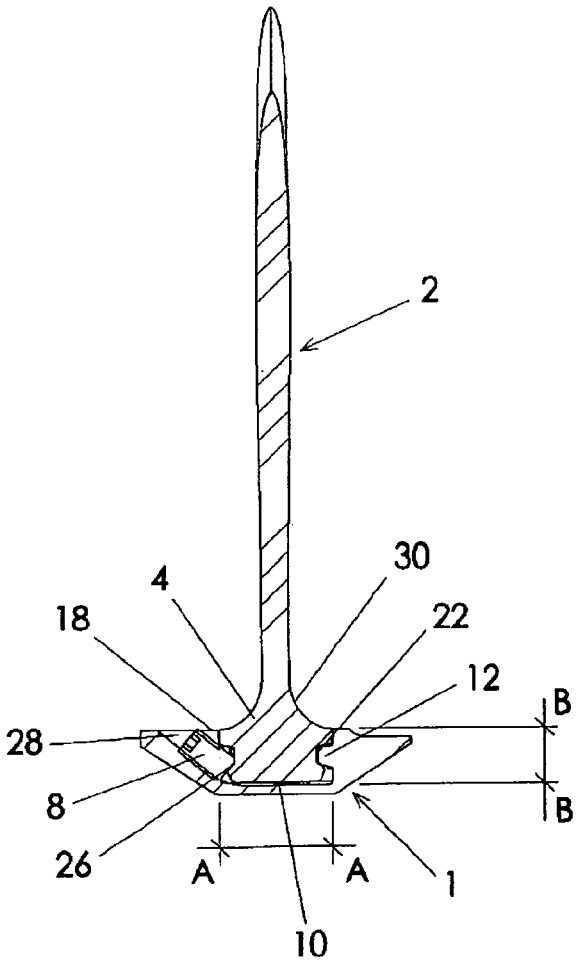
FIG. 9 is a cross sectional view of the fin box of FIG. 1, showing the fin installed.

As best shown in FIGS. 4 and 5 and 9, the fin box 1 includes retaining means in the form of elongate protrusions 12 extending from an internal side wall 14 of the receiving portion 10. The elongate protrusions 12 engage part of the base 4 in the present embodiment. The fin box 1 also includes impediments 17 which are placed between the protrusions 12 on each side of the fin box 1.

The receiving portion 10 has a through aperture 28 for receipt of a securing means which is in the form of a grub screw 8. The through aperture 28 is designed such that it facilitates angular insertion of the grub screw 8. The through aperture 28 is threaded on its internal bore allowing the grub screw 8 to be progressively driven towards the base 4 until it is stopped by the shoulder 26. Shoulder 26 is partly made of a hard material, such as metal in this embodiment, and adjoins an element designed to shear at a predetermined load, thus enabling the fin base 4 to break free from the fin box 1, minimising damage in the event of a severe impact.

Figure 7:
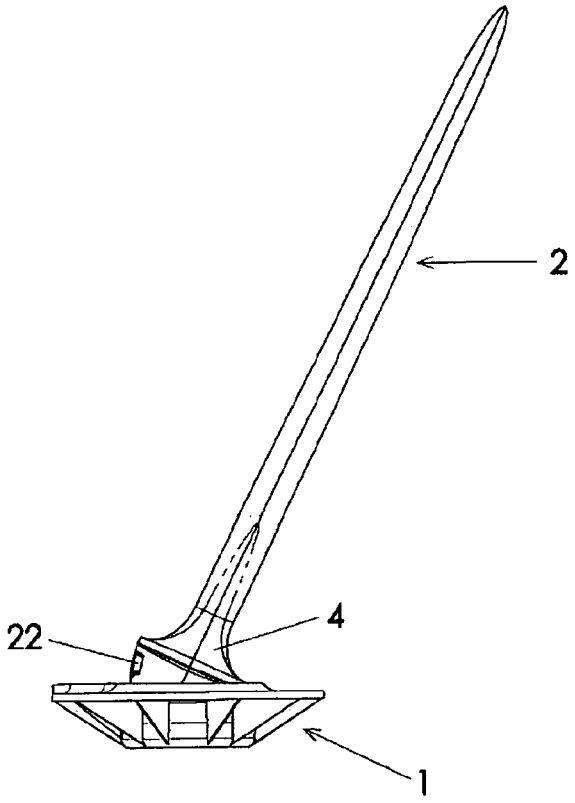
FIG. 7 is an end elevation from the front of the fin box of FIG. 1 receiving a fin.
Figure 8:
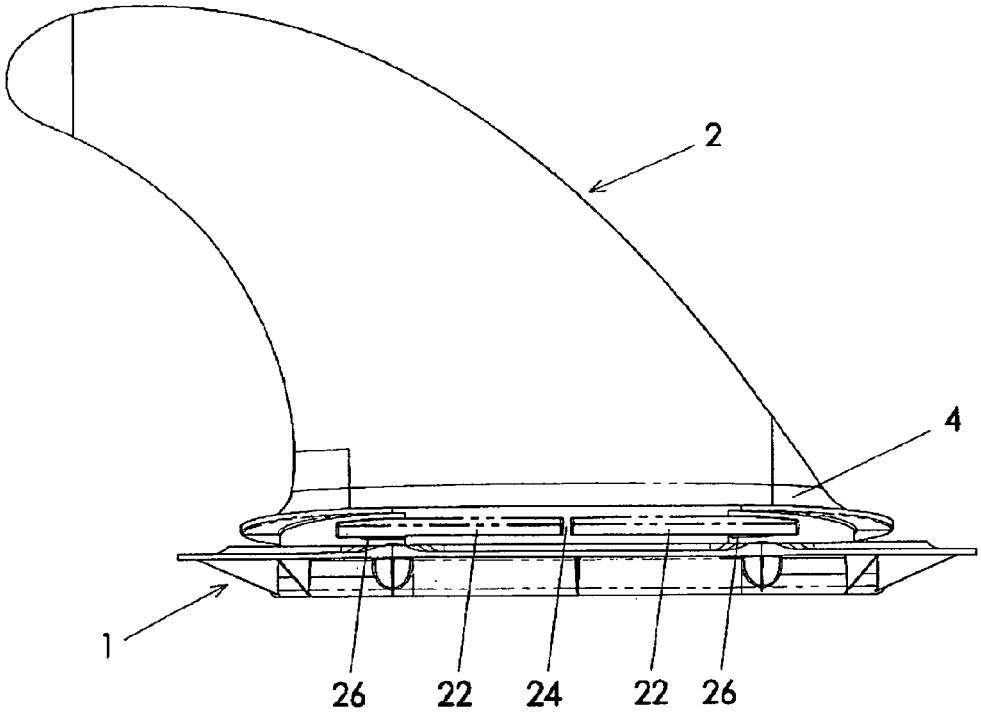
FIG. 8 is a side elevation from the left of the fin box of FIG. 1 receiving a fin.

Referring to FIG. 9, the width of the base 4 is indicated by A-A. The base 4 has an optimised width so as to enhance its stability when in engagement with the receiving portion 10. The base 4 also has a minimal depth indicated by B-B so as to facilitate insertion thereof into the receiving portion 10 from one side (refer to FIGS. 6, 7 and 8). The base 4 includes sections 24 on opposing sides thereof (refer to FIGS. 6 and 8). The sections 24 are placed so as to facilitate engagement with corresponding slots 16 in the receiving portion 10 in two or more discrete longitudinal positions. Slots 22 located on the opposing sides are adapted to mate with the respective elongate protrusions 12. It should be noted the slots 22 are longer than the respective protrusions 12, which means that the slots 22 are movable longitudinally along the length of the respective protrusions 12. Each slot 22 includes an engagement means in the form of a shoulder 26 which in use is engaged by the grub screws (not shown) in the present embodiment, for securing the base 4 to the receiving portion 10. In this embodiment, the shoulders 26 form part of the slots 22, respectively. The shoulders 26 which form a portion of the respective slots 22 are planar surfaces tilted towards the grub screws to facilitate abutment. In this embodiment, each shoulder 26 is tilted towards the grub screws (or the direction from which the grub screws are inserted into the through apertures 8. Each shoulder 26 is connected to the base 4 via a frangible element or an area of weakness (not visible) adapted to fracture at a predetermined load, for example when the fin hits a rock, thereby enabling the fin 2 to break away from the fin box 1. This is advantageous in that damage to the fin box 1 and watercraft can be minimised in the event of an accident. The frangible element or area forms an integral part of the base. In the most preferred embodiment, at least part of the shoulders 26 is made of or coated with a harder material than that of the base 4 or fin 2.

The elongate protrusions 12 are located in proximity to an upper edge 18 of the receiving portion 10. This allows the receiving portion 10 to have the minimal depth (indicated by B-B) for stably supporting the base therein.

To operate this embodiment, the user must first determine where the fin 2 is to be located. A side of the base 4 is then inserted into the receiving portion 10 at the selected longitudinal location. As one side of the base 4 enters the receiving portion 10, the protrusions 12 mate with the respective slots 22. The section 24 is aligned with one of slots 16, thereby restricting longitudinal movement of the base 4 within the receiving portion 10. The other side of the base 4 is then dropped into the receiving portion 10. Two grub screws 8 are driven into the through apertures 28 respectively until the ends of the grub screws 8 abut the shoulders 26 of the respective slots 22. In this way, the pressure exerted by the grub screws 8 on the respective shoulders 26 firmly secures the base 4 within the receiving portion 10 at the selected location. If and when the user wants to shift the fin 2 forward or rearward, the grub screws 8 need to be unscrewed allowing the fin 2 to be removed and re-engaged in a desired longitudinal position (i.e. either forward or rearward of the initial position). Once the fin 2 is moved to the desired position, the grub screws 8 are re-applied as described above to secure the base 4 in place.

Figure 6:
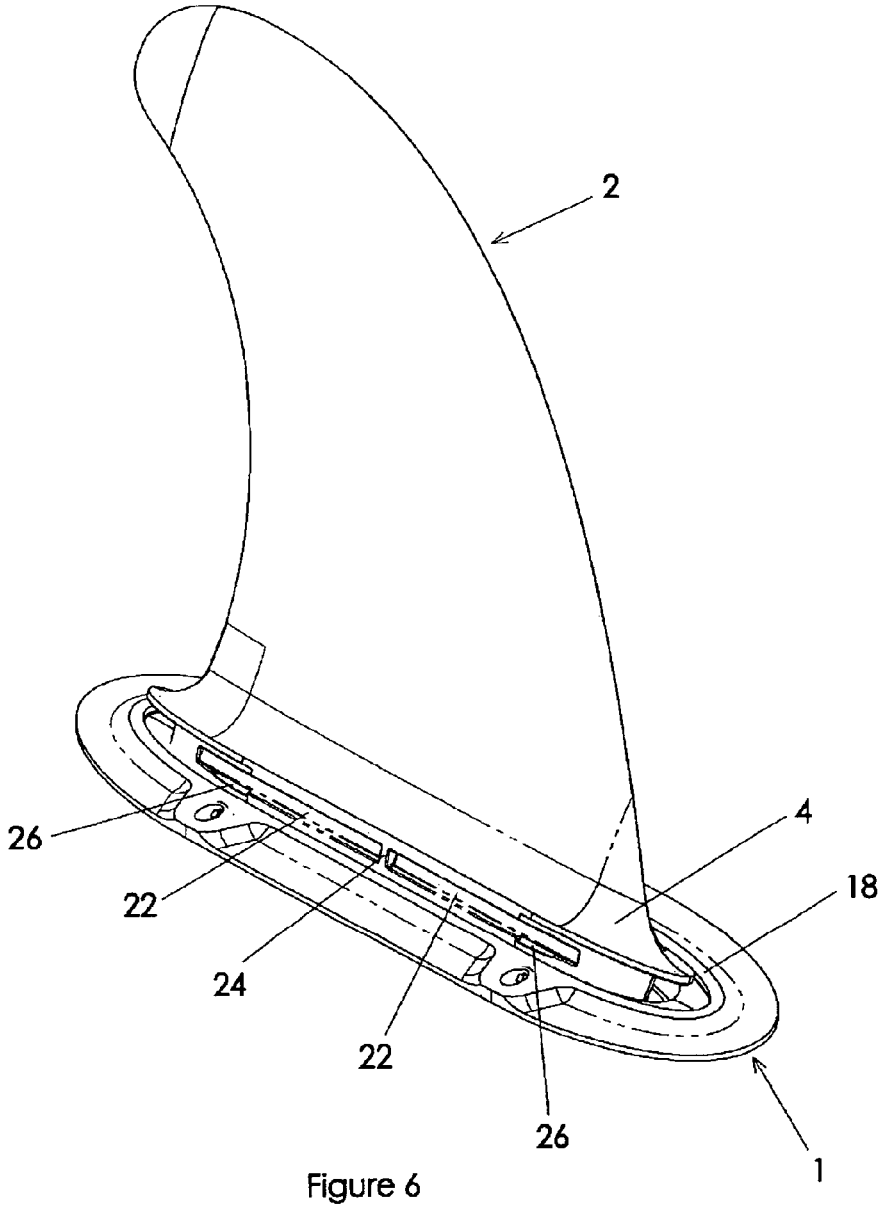
FIG. 6 is a perspective view of the fin box of FIG. 1 receiving a fin.

Although not readily visible from FIG. 6, each shoulder 26 is connected to the base via a frangible element or an area of weakness adapted to fracture or shear at a predetermined load, for example when the fin hits a rock, thereby enabling the fin to break away from the fin box 1. This is advantageous in that damage to the fin box and watercraft can be minimised in the event of an accident. The frangible element or area of weakness in this embodiment forms an integral part of the base 4. Also, part of each shoulder 26 is coated with a harder material than that of the base 4 or fin 2.

Figure 6A:
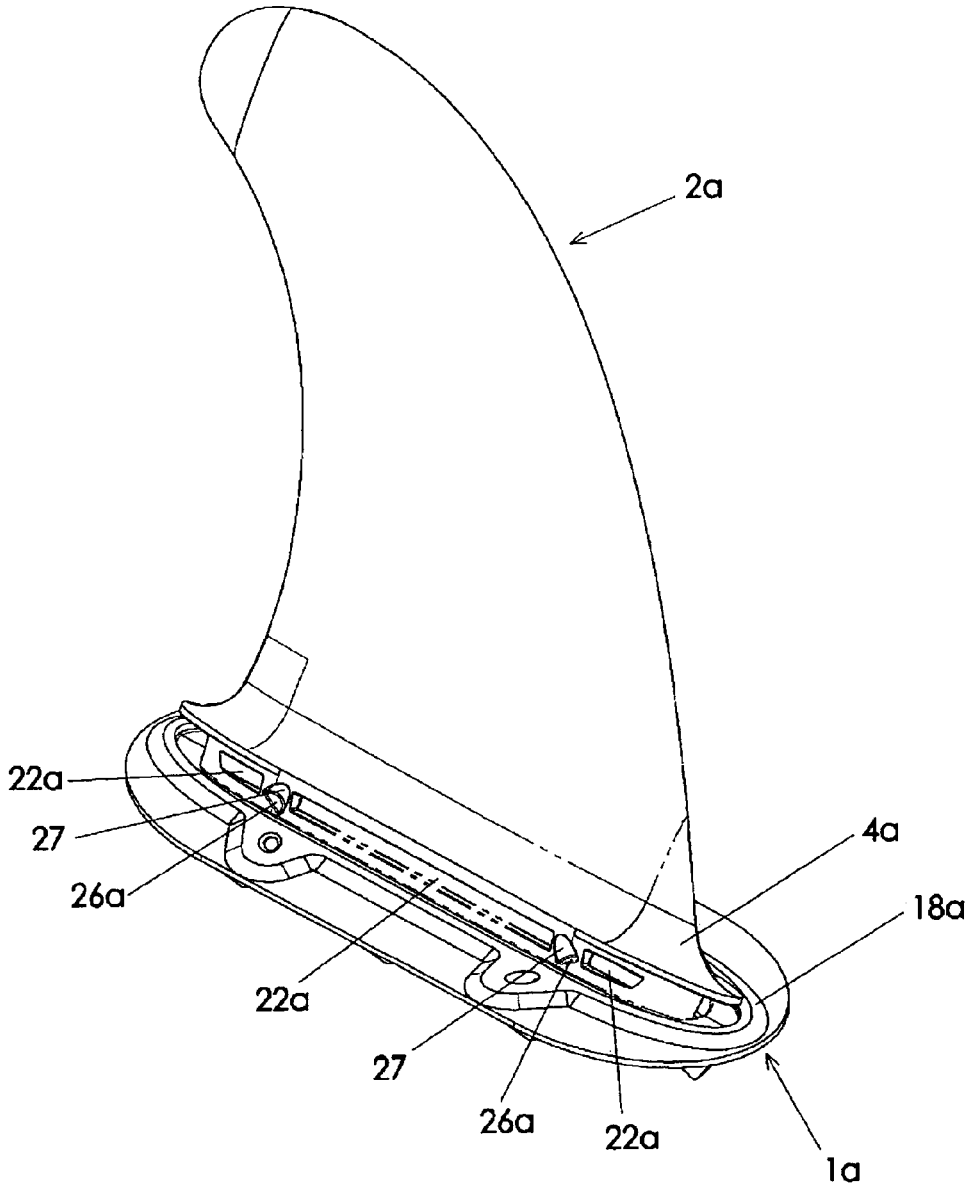
FIG. 6*a* is a perspective view of a fin box in accordance with another embodiment of the present invention.

Referring to FIG. 6*a*, in this embodiment, the fin 2 is adapted to be received in a single position within the fin box 1*a*. In other words, the fin 2*a* is not movable within the fin box 1*a*. As such, both the impediments 17 on the fin box 1*a* and the sections 24 (refer to FIG. 6) dividing the slots 22 become redundant and hence are omitted. In fact, three slots 22*a* are provided in the base 4*a* in this embodiment. The base 4*a* includes two orifices 27 into which engaging means in the form of tilted shoulders 26*a* extend. The shoulders 26*a* are tilted towards one another. During installation, grub screws (not shown) go through the respective through apertures angularly to abut the respective tilted shoulders 26*a*.

As best shown in FIG. 9, the base 4 is contiguously adjoined to the surface of the surfboard when in use. The base 4 has a streamlined profile so as to minimise resistance to a current of water. The base also has a currently diverging contour so as to provide an adjoining region 30 with a smooth transition from the body of the fin 2 to the surface of the surfboard. The adjoining region 30 may also be referred to as a fillet radius running around the base 4 of the fin 2, so as to form a smooth blend from the surface of the fin 2 to the top surface of the sanded fin box 1 and the finished surface of the surfboard. The diverging contour has the effect of decreasing turbulence in the flow of water around the base 4 of the fin 2 thereby making the surfboard faster and more responsive. By varying the geometry of the blend between the fin 2 and surfboard, the characteristics of the fin 2 can be varied to suit different conditions and riding styles.

Figure 10:
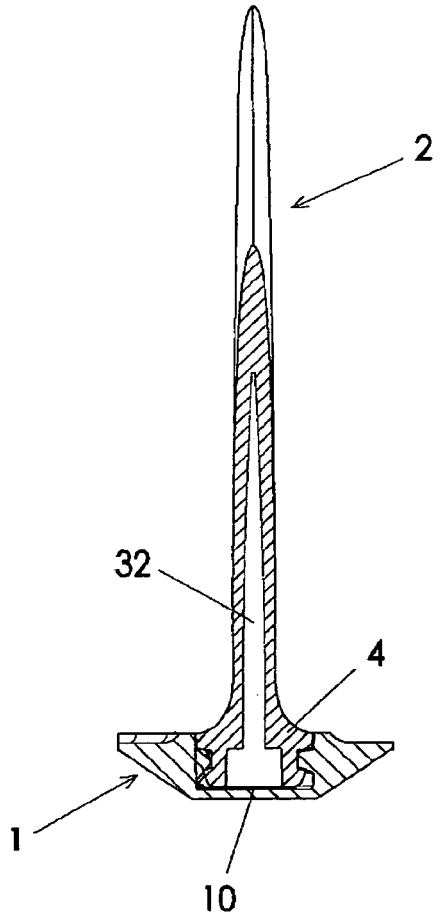
FIG. 10 is a cross sectional view of the fin box of FIG. 1, showing the fin with a hollow internal cavity.

As shown in FIG. 10, the underside of the fin 2 may be cored out to create a hollow cavity 32 thereby reducing the weight of the fin 2. The cavity 32 may vary in length, width and depth. The cavity 32 in a preferred embodiment allows introduction of a replaceable or variable stiffening element for the control of the lateral stiffness of the fin.

Figure 11:
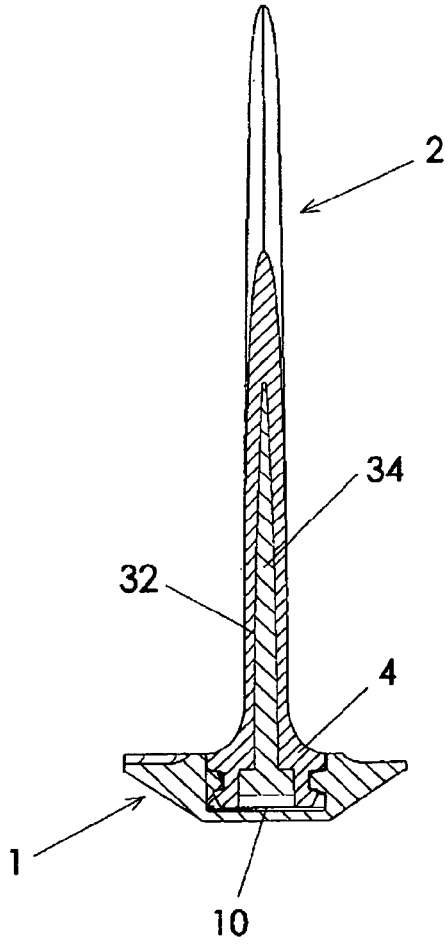
FIG. 11 is a cross sectional view of the fin box of FIG. 1, showing the fin with a hollow internal cavity having an internal stiffening.

As shown in FIG. 11, the stiffening element 34 in the present embodiment is replaceable. As such, other elements of varying stiffness may be used to alter the characteristics of the fin by removal of the existing element 34, and replacement with another stiffer or more flexible one. In another embodiment, the stiffening element 34 is integral with or permanently installed in fin 2, and consists of a component with variable lateral stiffness. In this embodiment, the stiffness may be varied by means of changing the cross section of the element by rotation or other means, by varying the internal stresses in the element or the fin itself, or by other appropriate means.

Figure 12:
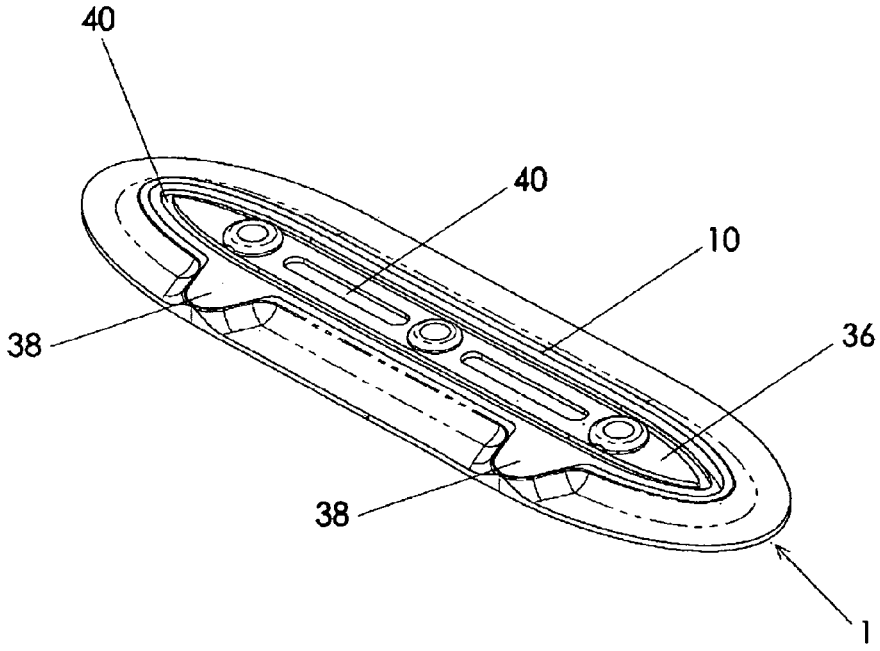
FIG. 12 is a perspective view of the fin box of FIG. 1 with a removable lid in use.

Turning now to FIG. 12, a removable lid 36 is provided to seal the receiving portion 10. The lid 36 functions as a sacrificial cover which is snugly fitted into the fin box 1. The lid is shaped complimentarily to the opening of the receiving portion such that once the lid is put in place, the fin box 1 becomes substantially fluid-proof. The lid 36 has fastening means (not shown) for securing the lid 36 to the fin box 1. The fastening means in this embodiment comprises a press or clip fit mechanism but may take other forms such as threaded fasteners or quarter turn fasteners. The lid also has two tabs 38 for covering the respective holes provided for the two grub screws 8.

Figure 13:
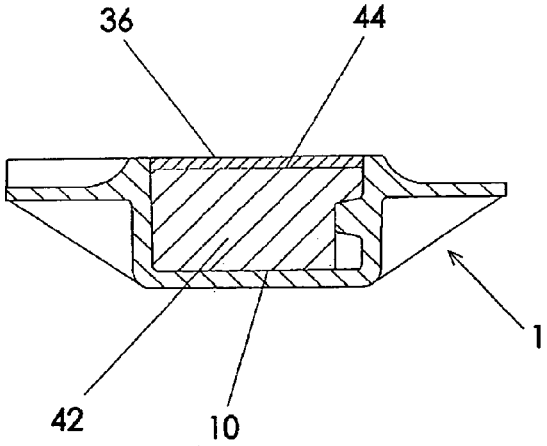
FIG. 13 is a cross sectional view of the fin box of FIG. 1, showing a sanding infill and a removable lid in use.

As shown in FIG. 13, a sanding infill 42 is provided. The sanding infill 42 is placed in receiving portion 10 of fin box 1 prior to attachment of lid 36. An upper surface 44 of sanding infill 42 matches the height to which the edges of fin box 1 are desired to be sanded. The upper surface 44 of the sanding infill may be substantially plane, cylindrical, or any compound shape as desired, and defines the final sanded surface of the surf craft adjacent to the fin box 1. The sanding infill 42 may include means (not shown) means which facilitate attachment of the removable lid 36 and/or a positioning means in the form of a plate 46 (see FIG. 14) to the infill 42. The sanding infill 42 may also have cavities (not shown) to allow for its removal from the fin box after sanding is completed. The sanding infill may be solid or hollow.

In this embodiment, the sanding infill 42 is made of a material which is harder than the fin box 1, and also than the resin used to secure the fin box 1. Additionally, the sanding infill 42 is made of a material which does not cause sparks when it is abraded by a sanding disc. In the most preferred embodiment, the sanding infill 42 is made of or coated with a ceramic material, and is reusable.

Figure 14:
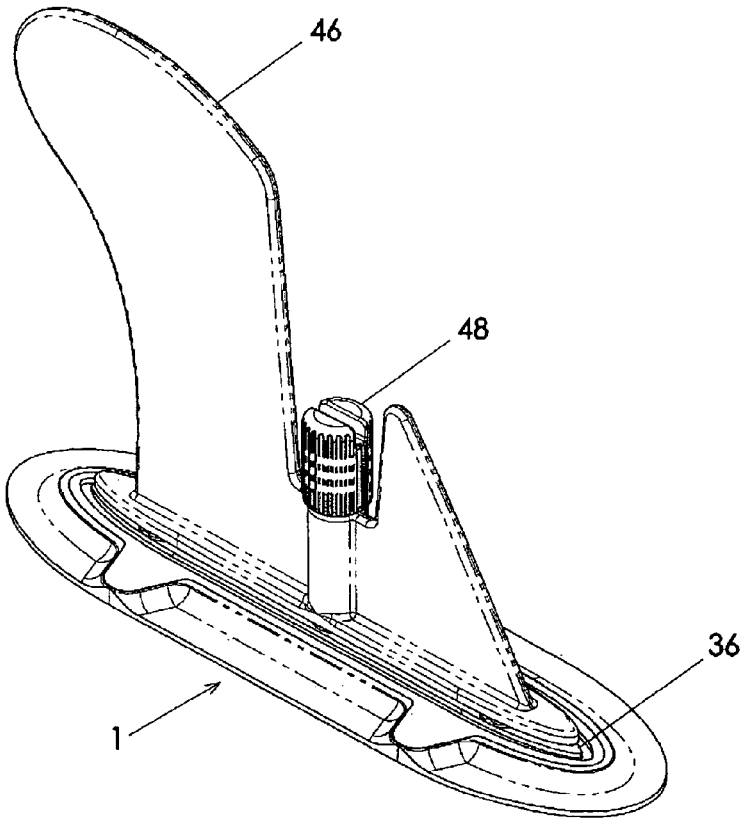
FIG. 14 is a perspective view of a the fin box of FIG. 12, with a removable lid being connected to an alignment plate.

Referring to FIG. 14, the plate 46 forms an integral part of or is removably attachable to the lid 36. The plate 46 is used to facilitate angular adjustment of the fin box 1 with respect to the surfboard. The plate 46 is removably attachable to the lid 36 by a press or clip fit mechanism. Attachment however may also be effected by using fastening means such as threaded fastener(s) 48 or quarter turn fastener(s), or other suitable means.

In this embodiment, the lid 36 plays a key role in preventing resin from entering the fin box 1 when the fin box 1 is 'glassed' to the surfboard in the manufacturing process, eliminating the necessity for masking tapes. The sanding infill 42 in the present embodiment reduces the length of time required to sand away the resin covering the fin box 1 by eliminating the need to continually check the sanding depth, and by preventing over sanding.

The procedure involved in manufacturing a surfboard with the fin box 1 of the present invention will now be described. The first step is to shape a foam surfboard blank to a desired form. A cavity for each fin is then routed in the underside of the blank to receive the fin box 1 using a router jig. The foam blank is covered with a glass fibre mat and resin to provide a strong and rigid surface. The areas around the fin box 1 are left uncovered. The surface of the surfboard is sanded to provide a smooth finish. Sanding infill 42 is then placed in the receiving portion 10 of fin box 1, and lid 36 is clipped into the fin box. The plate 46 is then attached to the lid 36 and/or sanding infill 42, to provide a visual indication of the lateral angular orientation of the fin box 1 with respect to the surface of the surfboard. Also, the plate 46 provides a convenient handle for holding and manipulating the fin box 1 when it is being painted with resin for adhering into the cavity provided in the surfboard.

Turning to FIG. 14, once the fin box 1 is fixed into the surfboard, the plate 46 is removed. The plate 46 in the present embodiment is made of a material to which polyester resin does not adhere, for example, polyethylene, and is reusable. The fin box 1 is then 'glassed over' with a glass fibre mat and laminating resin resulting in a patch of fibre glass over the fin box 1. The lid 36 and sanding infill 42 are kept in the fin box 1 at this stage. The resin covering the fin box is sanded back to be flush with the previously glassed surface of the surfboard. Upper surface 44 of sanding infill 42 now limits the depth to which the resin covering the fin box can be sanded, by dint of its superior hardness compared to the resin. The lid 36 in a preferred embodiment is completely sanded away. The sanding infill is then removed from the fin box by leverage. In an alternative embodiment, sanding infill 42 is not used. In this case, depth indicators 40 (refer to FIG. 12) are provided on the lid 36 to assist in determining the desired sanding depth. For instance, the edge of the fin box 1 may be sanded down substantially precisely by 1.25 mm. The lid 36 is then removed from the fin box 1 by leverage.

In both embodiments described above, the fin box is glued into the cavity in the foam blank and laminated to the underside surface of the surfboard by having glass fibre and resin over the flange of the fin box 1. The glass fibre and resin hold the fin box securely in the surfboard. The surfboard is by this time ready for removable fins to be installed.

Figure 15:
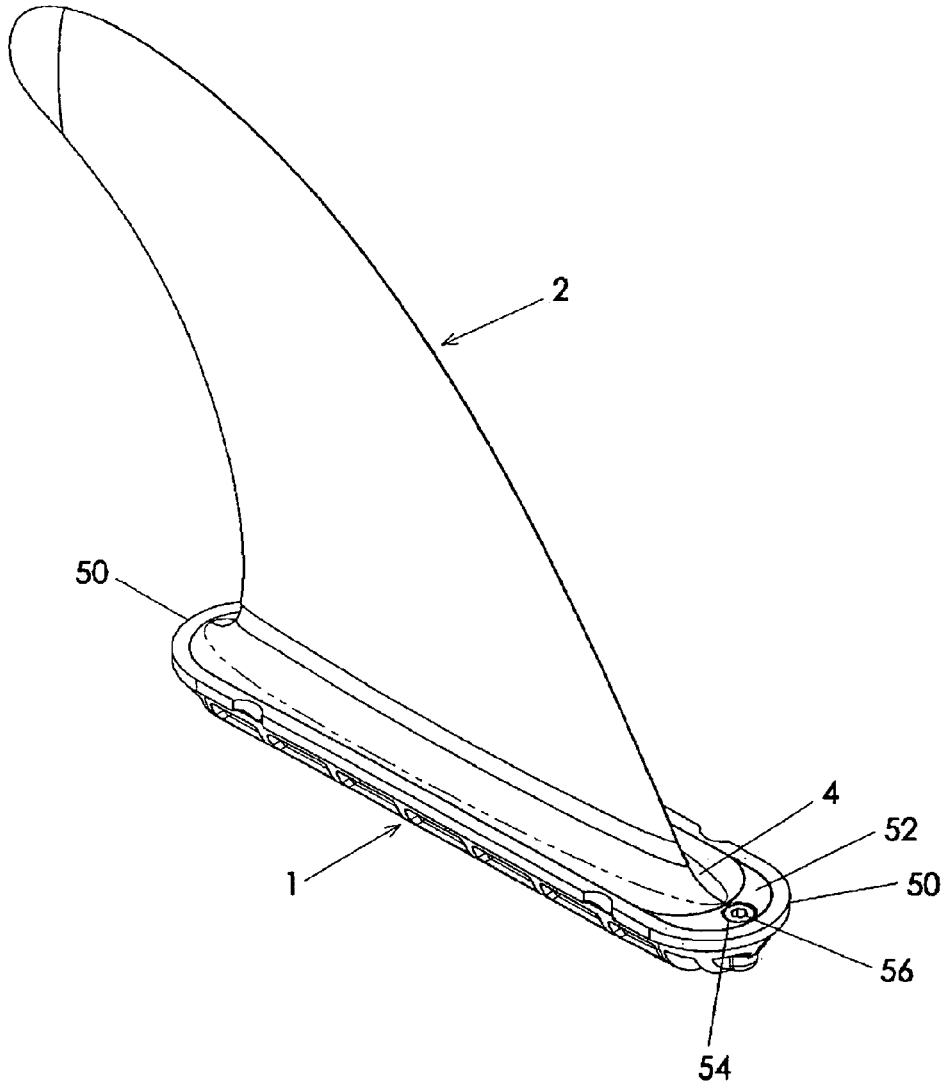
FIG. 15 is a perspective view of another embodiment of the fin box of the present invention, illustrating one embodiment of a quarter-moon-shaped plate, with the fin installed in the rear position.
Figure 16:
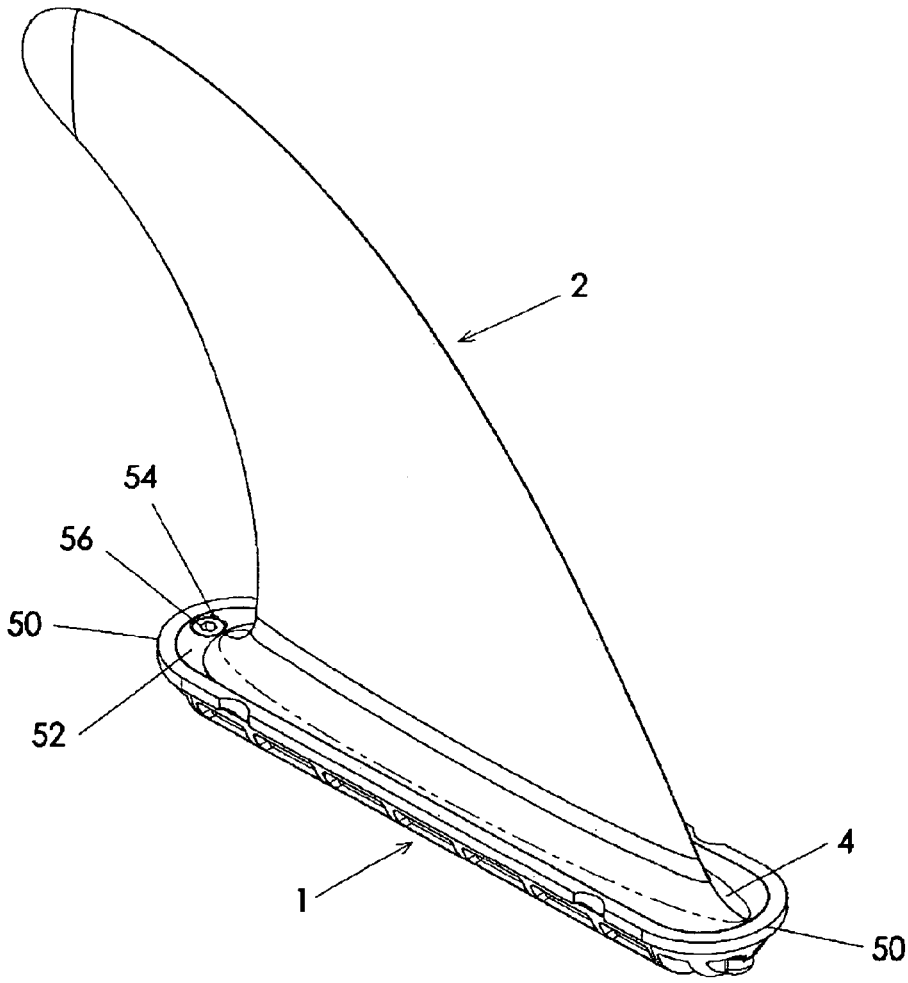
FIG. 16 is a perspective view of the fin box of FIG. 15, with a fin installed in the front position.
Figure 18:
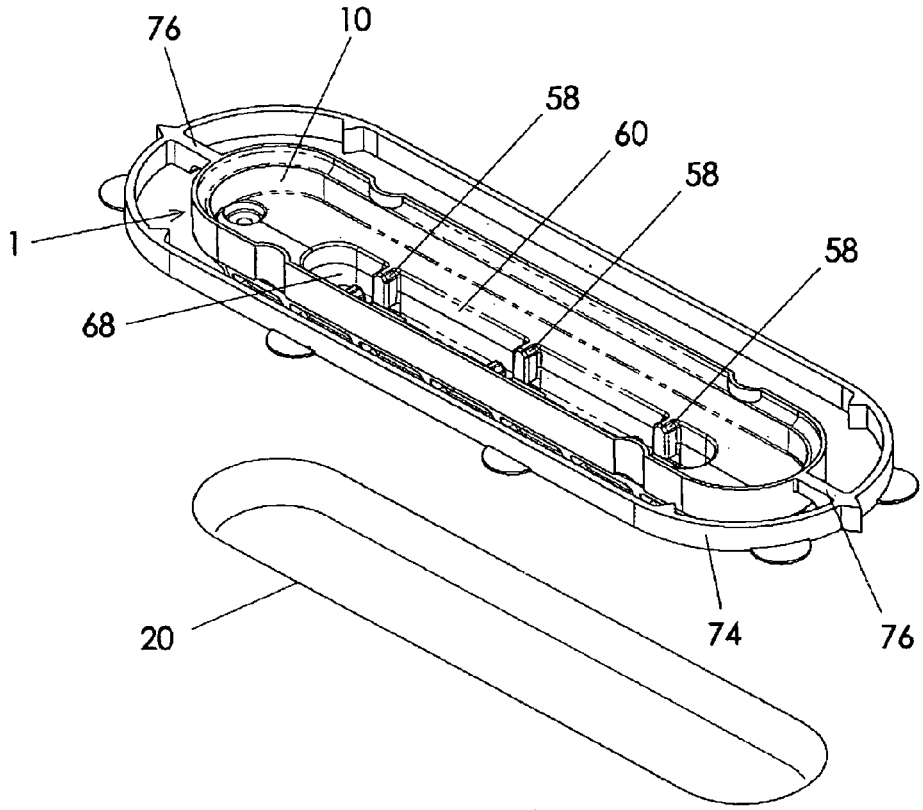
FIG. 18 is a perspective view of the fin box of FIG. 15 with the resin dam omitting the fin, and showing the cavity in the surfboard.

Referring now to FIGS. 15 and 16, another embodiment of the present invention is shown. In this embodiment, the fin box 1 is fitted to a watercraft such as to the deck of a surfboard (not shown). The fin box 1 is elongate in shape having arcuate ends 50, and receives a fin 2 in a front or rear position. Referring to FIG. 18, the fin 2 is received within the fin box 1 which is in turn received in a cavity 20 provided in the watercraft. The fin box 1 includes a receiving portion 10 and securing means 52 (refer to FIG. 16). The receiving portion 10 is longer than the base 4 of the fin 2. The base in the present embodiment is in the form of a flange. The securing means 52 is for locking the fin 2 in a chosen longitudinal position in the receiving portion 10, and may be located at either end of the fin box 1, depending on whether the fin is desired to be in the fore or aft position.

Figure 17:
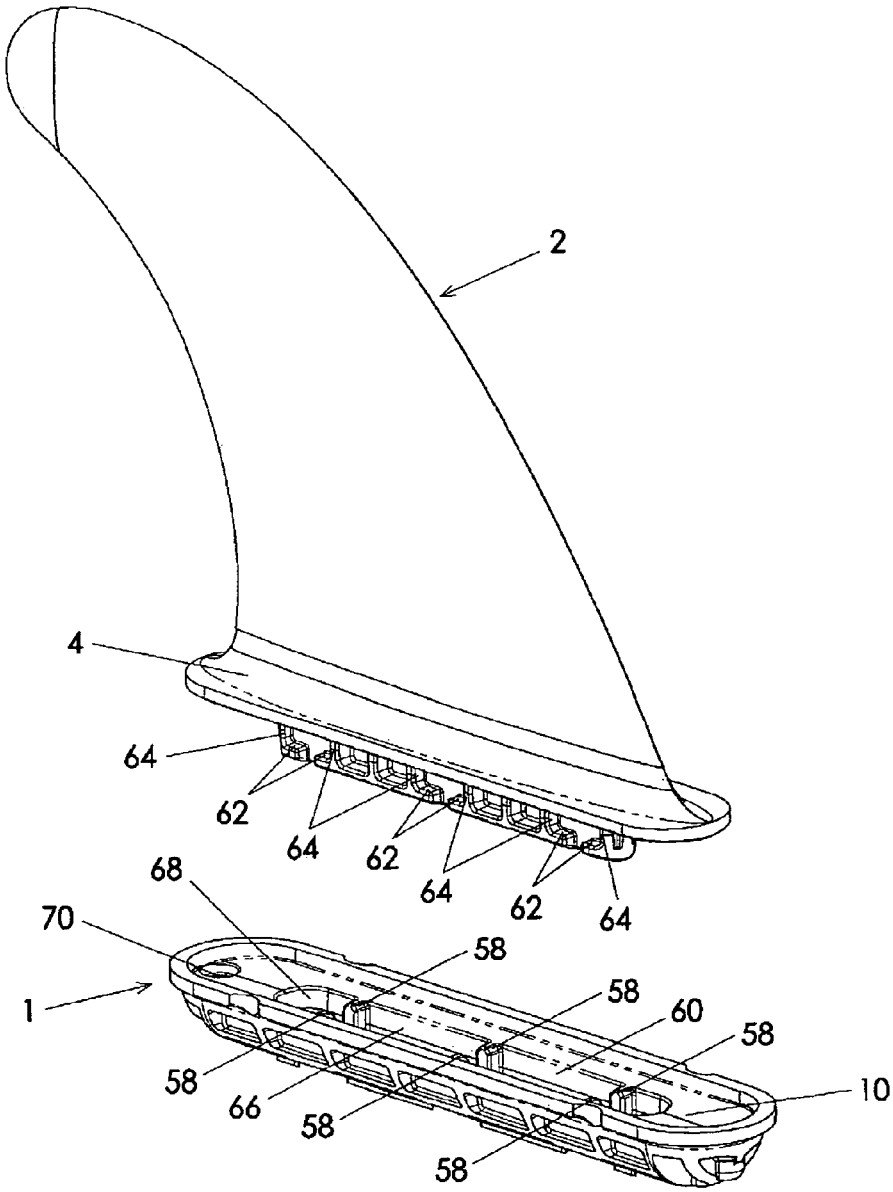
FIG. 17 is a perspective view of the fin box of FIG. 15, with an uninstalled fin.
Figure 19:
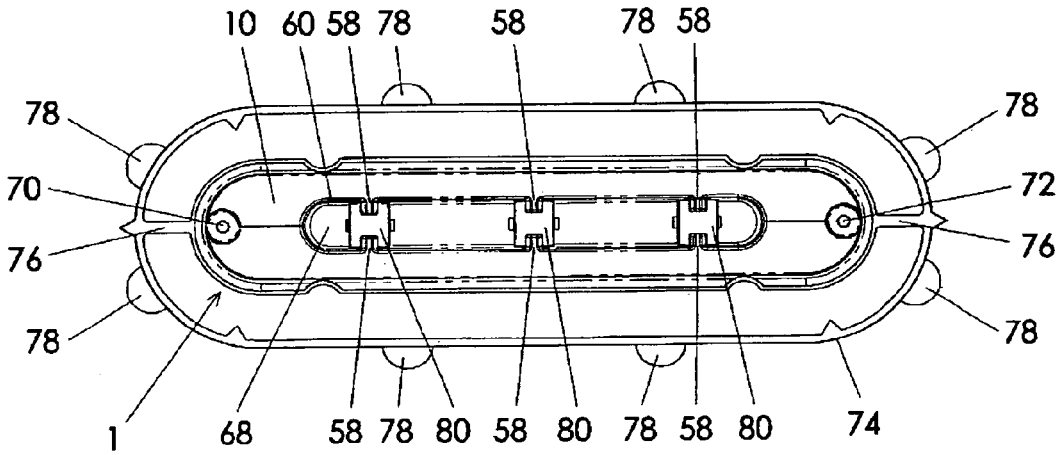
FIG. 19 is a plan view of the fin box of FIG. 15, omitting the fin.

As best shown in FIGS. 17, 18 and 19, the fin box 1 includes three pairs of retaining means in the form of lugs 58 extending from a wall 60 of the receiving portion 10. The lugs 58 function to retain the fin 2 within the fin box 1. Referring to FIG. 17, the base 4 also includes legs 64. The receiving portion 10 includes a recess 68 for accommodating the legs 64. The legs have feet 62 for engagement with the respective pairs of lugs 58. During installation, the feet 62 are in engagement with the lugs 58 thereby preventing the fin 2 from becoming detached from the fin box 1.

Referring now to FIGS. 15 to 19, the securing means includes a member 52 which covers a gap between the receiving portion 10 and the fin 2 after placement thereof. The member 52 is designed to be releasably fixed to receiving portion 10 by way of a fixture such as a screw 56 having a flat head in the present embodiment. During installation, the screw 56 passes through an opening 54 in the member 52 and engages threads 70 and 72 of the receiving portion 10. The screw 56 moves downwards along the threads 70 or 72 until the flat head of the screw 56 firmly abuts the surface of the member 52. Being in such a position, the member 52 is substantially flush with the base 4 of the fin 2 and prevents longitudinal movement of the fin 2. In the most preferred embodiment, the member 52 is in the shape of a fingernail or quarter-moon being complementary to the ends of the base 4 of the fin 2.

It can be appreciated that the member 52 may be disconnected from the threads 70 for engagement with the threads 72 (see FIG. 19). As such, the member 52 is removable as well as movable from one end of the receiving portion 10 to the other. When the member 52 is not applied, the base 4 is shiftable towards one end or the other. In contrast, once the member 52 is locked in place to either of the threads 70 or 72, the base 4 can no longer move longitudinally along the length of the fin box 1. In the embodiment, the only tool that is required is a screw driver or Allen key to secure the member 52 to the threads 70 or 72. The member 52 is therefore easy for a user to carry and apply when removing, installing, repositioning or exchanging a fin.

Referring to FIG. 19, the fin box 1 is affixed to the watercraft by an adhesive material. The adhesive material in this embodiment is a resin. The fin box includes a dam 74 for receipt of the adhesive material. The dam 74 surrounds the fin box 1 conforming to the shape thereof. In this embodiment, the dam 74 is integral with the fin box and the dam 74 is connected to the fin box via a plurality of struts 76. The dam 74 includes a plurality of tabs 78 evenly distributed throughout the body of the fin box 1. The dam 74 is partially removed such that there is no protrusion out of the watercraft. In this embodiment, the dam 74 is partially removed by sanding for practical as well as aesthetic purposes. As shown in FIGS. 15 and 16, after the dam 74 is removed, only the receiving portion 10 of the fin box 1 is left.

Referring to FIGS. 17 and 19, the receiving portion 10 has a round bottom with three windows 80, which correspond to the three pairs of retaining means 58 respectively. The windows 80 are provided for ease of manufacturing, and are sealed prior to installation of the fin box in a surfboard.

Figure 20:
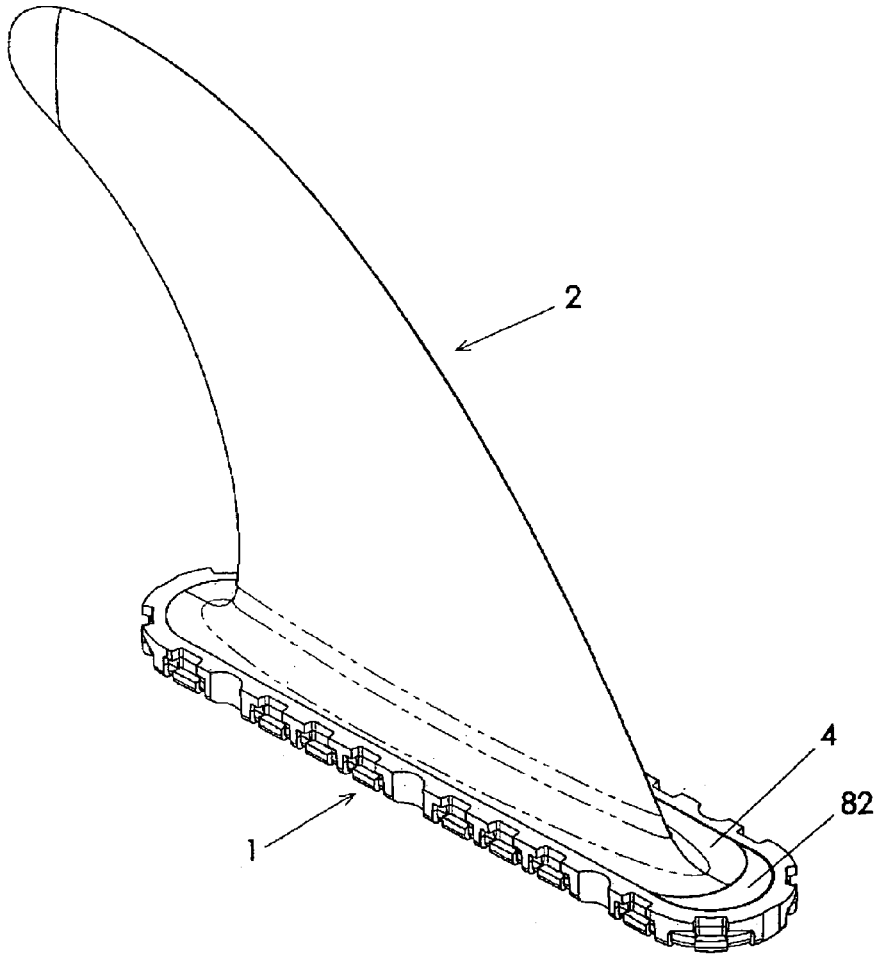
FIG. 20 is a perspective view of a further embodiment of the fin box of the present invention, and illustrating a second embodiment of the quarter-moon-shaped plate, with the fin installed in the rear position.
Figure 21:
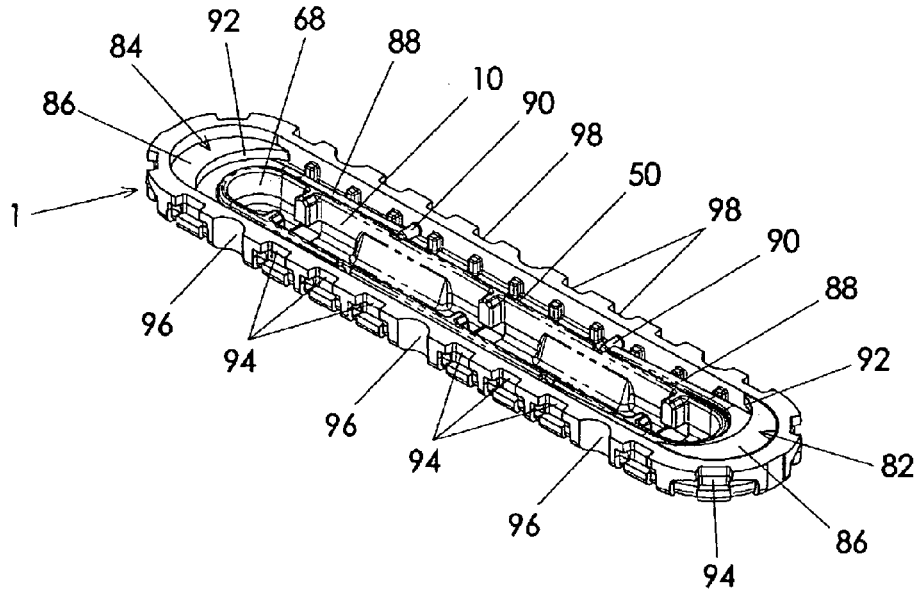
FIG. 21 is a perspective view of the fin box of FIG. 20 omitting the fin.
Figure 22:
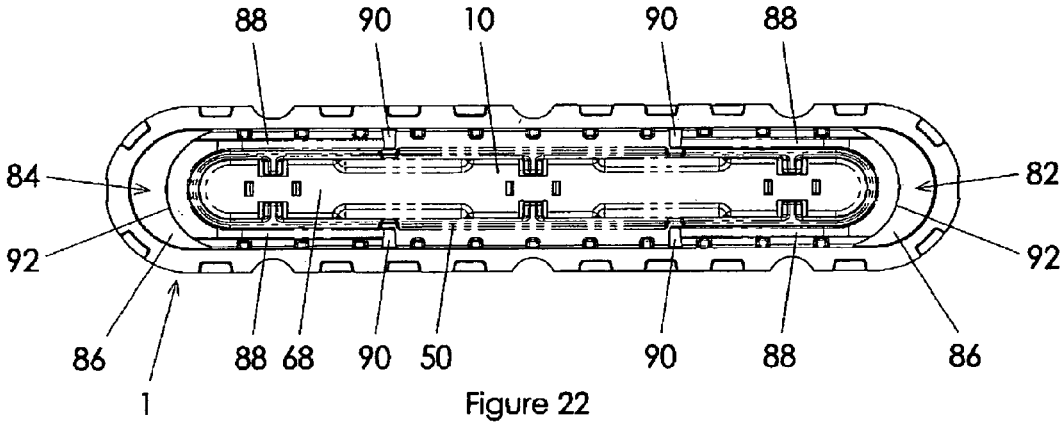
FIG. 22 is a plan view of the fin box shown in FIG. 20, omitting the fin.

Referring now to FIGS. 20 to 22, a further embodiment of the present invention is shown. As shown in FIGS. 21 and 22, two (instead of one) securing means 82 and 84 are provided. Each securing means is configured so as to be at least partially movable from a suppressed position to a released position for impeding longitudinal movement of the fin 2. The receiving portion 10 includes a circumferential shoulder 50 defining the recess 68 for accommodating the legs on the base 4 of fin 2 (not shown).

The securing means in this embodiment includes a head portion 86 and a pair of arms 88. Each of the pair of arms 88 includes a return 90 for engagement with the receiving portion 10. The head portion 86 includes a step 92 such that the base 4 of is the fin 2, once put in place, is flush with the elevated part of the head portion 86. The pair of arms 88 are located intermediate the shoulder 68 (refer FIG. 17) and the fin base 4 (ie. flange). The shoulder 68 includes a pair of props (invisible in FIG. 22) on which the pair of arms 88 rest, respectively. The securing means 82 and 84 in this embodiment are biased by the props to the released position when the base 4 is shifted to one end. As such, the head portion 86 impedes longitudinal movement of the base 4 when the securing means 82 or 84 is in the released position thereby facilitating locking of the fin 2 in a predetermined position. It is important to note that the fin box 1 of the present invention is configured to enable installation and removal of the fin without tools, particularly heavy-duty tools.

Figure 23:
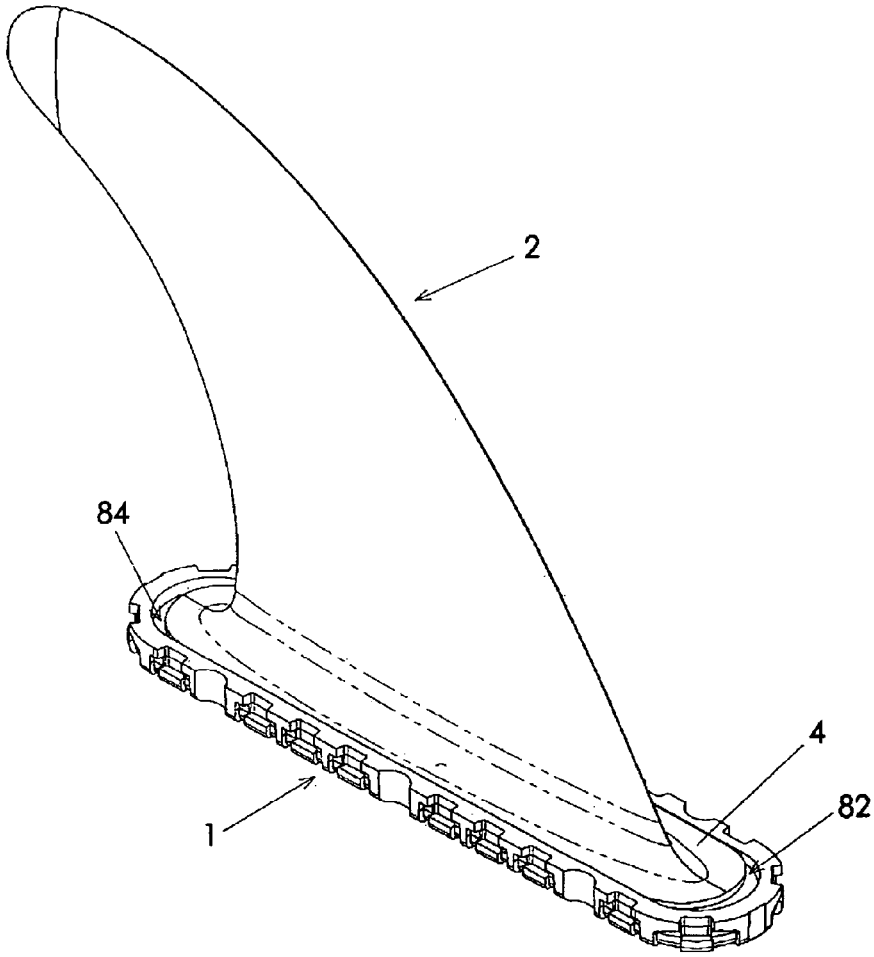
FIG. 23 is a perspective view of the fin box of FIG. 20 showing the fin in a centre position in the fin box.

As can be seen in FIG. 22, the two securing means 82 and 84 are located at opposite ends of the fin box 1. When in use, one securing mean is in a suppressed position while the other securing means is in an extended position. Suppression of one securing means from the extended position to the suppressed position enables longitudinal movement of the fin 1 along the receiving portion 10. As such, the location of the fin 1 is moved from a rear (locked) position as shown in FIG. 20 to a middle (unlocked) position as shown in FIG. 23, and thence to a front (locked) position.

Referring now to FIG. 21, the external surface of the fin box 1 has a framework 94 so configured as to facilitate positive and interlocking engagement thereof with the resin during installation of the fin box into a surf board. The external surface of the fin box 1 also includes guiding means for directing flow of the resin throughout the receiving portion during installation. The guiding means in the present embodiment are in the form of channels 96 and 98 and through apertures (not shown) provided throughout the wall of the fin box 1 to enable thorough penetration of the resin so as to encapsulate selected positions of the framework.

The receiving portion 10 of the embodiments described, are but need not be, substantially symmetrical in shape. Also, the receiving portion 10 is designed to receive different fins for different purposes. For instance, the receiving portion 10 in this embodiment can receive either a centre or a side fin.

Furthermore, the receiving portion 10 is capable of receiving various fins retrofitted with an adaptor (not shown). The adaptor may be adapted to mount onto a fin and vary in size so as to fit onto fins of different shapes and sizes. The adaptor and fin may be releasably connected by way of an interlocking mechanism or permanently fixed together.

Installation and operation of the fin box 1 of this embodiment of the present invention are now described. In order to install the fin box 1, a predetermined volume of foam core is excavated from the underside of the watercraft creating a cavity. The fin box is then inserted into the cavity and a polyester resin poured into the space between the box and the foam. Once the resin has set, the protruding edges of the dam 74 are sanded flush with the surfboard. The strength of the joint between the fin box 1 and watercraft is critical as it determines the stiffness of the fin. Following placement of the fin box 1, the fin 2 is then inserted into the receiving portion 10 of the fin box 1. The legs of the base 4 should be lowered into the receiving portions in between the lugs 58. Once the base 4 is set in place, it is slid longitudinally along the length of the receiving portion 10 until the rectangular feet 62 engage the corresponding lugs 58.

In the embodiment shown in FIGS. 15 to 19, following placement of the fin 2, the member 52 is screw fixed using one of the threads 70 or 72. Repositioning of the fin 2 would involve the steps removing the member 52, sliding the fin 2 to the opposite end of the receiving portion 10, and screw fixing the member 52 using the other thread, 72.

In the embodiment shown in FIGS. 20 to 23, as soon as the fin base is slid to one end of the receiving portion 10, one of the securing means, for example 82 will automatically pop, up locking the fin 2 in position. When it is desired to mode the fin position, the securing means 82 which is in the raised position is depressed, allowing the fin base 4 to be slid to the other end of the fin box 1. Once it has been moved to the new position, the securing means 84 at the opposite end pops up, preventing longitudinal movement of the fin 2.

Now that preferred embodiments of the present invention have been described in some detail, it will be apparent to those skilled in the art that the fin box of the invention is capable of having one or more of the following advantages over the prior art:

(i) building of a dam with modelling clay is no longer required for installation of the fin box;
(ii) installation and removal of the fin from the fin box may be effected with minimal tools;
(iii) the fin may be shifted and locked in position in a simple operation with minimal tools;
(iv) the longitudinal position of the fin relative to the fin box may be easily varied;
(v) the fin box may be located in the proximity of the shallow front or rear end of a watercraft;
(vi) the overall stiffness and flexibility of the fin may be varied;
(vii) provide a convenient way of preventing resin from flowing into the interior of the fin box;

(viii) provide an indication of the lateral angular orientation of the fin box within the surfboard in manufacturing process;

(ix) provide indicators to aid in establishing the correct depth of sanding during installation of the fin box;

(x) provide a stiff and secure mounting system; for the base of the fin, particularly in the lateral direction;

(xi) facilitate breaking off of the fin from the fin box on application of a predetermined lateral force;

(xii) allow adjustment of the lateral stiffness of the fin; and (xiii) provide a contoured base with enhanced hydrodynamics.

Those skilled in the art will appreciate that the invention described herein is susceptible to variations and modifications other than those specifically described. For example, the retaining means may take the form of a retractable latch or lock. The securing means and receiving portion may take another shape or form. All such variations and modifications are to be considered within the scope of the present invention the nature of which is to be determined from the foregoing description.

INDUSTRIAL APPLICABILITY

The fin box of the present invention is capable of facilitating insertion of a fin laterally from one side into a considerably shallow fin box being received within a surfboard. Also, the fin of the present invention can be movable within the fin box and offers enhanced hydrodynamics, which significantly improve the control and performance of the surfboard.

The invention claimed is:

1. A fin system comprising:

a fin box securable to a watercraft and a fin, the fin box including:

a receiving portion having opposing first and second fin box side walls and an opening; and at least one protrusion extending from the first fin box side wall; and a fin including:

a body having a leading edge, a trailing edge, a first side face and a second side face in opposition to the first side face, the first and second side faces extending between the leading and trailing edges; and a base mounting portion having a first side having a at least one slot and an opposing second side, wherein the base mounting portion is insertable into the receiving portion in a first position in which the at least one protrusion is located adjacent to the at least one slot and the body is angularly inclined relative to a plane passing across the opening of the receiving portion, and wherein the body is pivotable to a second position in which the at least one protrusion is located in the at least one slot and the body is generally perpendicular to the plane passing across the opening of the receiving portion.

2. The fin system of claim 1, wherein a fillet extends between the base mounting portion and the body around an entire perimeter of the fin, the fillet providing a transition between an underside of the watercraft and the body, such that a tangent of the fillet at an edge of the base mounting portion is substantially coincident with an adjacent underside region of the watercraft.

3. The fin system of claim 1, wherein the receiving portion is longer than the base mounting portion and the base mounting portion is longitudinally movable between two or more positions within the receiving portion.

4. The fin system of claim 3, wherein the at least one slot in the base mounting portion includes a first slot and a second slot located adjacent each other, and the fin box includes a second elongate protrusion located adjacent to the at least one protrusion, and an impediment is located between the first and second elongate protrusions, such that a longitudinal position of the fin relative to the fin box may be selectively varied by locating the impediment in either the first slot or the second slot.

5. The fin system of claim 4, wherein the first and second elongate protrusions and the impediment are located adjacent to an upper edge of the receiving portion.

6. The fin system of claim 1, further comprising a biasing means to prevent any undesired movement of the fin when secured to the fin box.

7. The fin system of claim 6, wherein the biasing means drives a flexible or rotatable arm with a head.

8. The fin system of claim 1, wherein an external surface of the receiving portion comprises a framework for bonding with an adhesive material for affixing the fin box to the watercraft.

9. The fin system of claim 8, wherein the external surface includes a guiding means for directing flow of the adhesive material during installation.

10. The fin system of claim 9, wherein the guiding means includes channels provided throughout a wall of the receiving portion to enable penetration of the adhesive material so as to encapsulate selected portions of the framework.

11. The fin system of claim 1, further comprising a removable infill insertable within the receiving portion.

12. The fin system of claim 11, wherein an upper surface of the removable infill is shaped to correspond with a depth to which a layer of resin covering the fin box is desired to be sanded during installation.

13. The fin system of claim 12, wherein the upper surface of the removable infill is shaped so as to allow a surface of a surfboard to be sanded to a curved profile from front to rear of the fin box.

14. The fin system of claim 13, wherein the removable infill is releasably attached to a removable lid to seal the receiving portion.

15. The fin system of claim 14, wherein the removable lid includes one or more indicators for indicating a thickness of the removable lid.

16. The fin system of claim 15, further comprising a positioning means for angular adjustment of the fin box relative to the watercraft.

17. The fin system of claim 16, wherein the positioning means includes a plate removably attachable to the removable lid by a fastening means, the fastening means including a threaded fastener, a quarter turn fastener, a press, or a clip fit mechanism.

18. The fin system of claim 1, wherein the fin is securable to the fin box with a fastener.

19. The fin system of claim 18, wherein the fastener is insertable into a fastener receiving hole, and wherein a force applied by the fastener provides a clamping force between an underside of the at least one protrusion and an upper region of the at least one slot.

20. The fin system of claim 1, wherein the fin box further includes a recessed step located within the opening of the receiving portion, the recessed step extending generally parallel with the plane passing across the opening of the receiving portion.

21. The fin system of claim 20, wherein the recessed step has a depth generally corresponding to a thickness of an edge portion extending around a perimeter of the body adjacent to the base mounting portion.

22. A fin comprising:

a body; and a base portion, the base portion being removably received in a fin box mounted to an underside of a watercraft, wherein a fillet extends between the base portion and the body around an entire perimeter of the body, the fillet providing a transition between the underside of the watercraft and the body, such that a tangent of the fillet at an edge of the base portion is substantially coincident with an adjacent underside region of the watercraft, wherein an underside of the base portion of the fin is cored out to provide a hollow for receiving a removable stiffening element for controlling a lateral stiffness of the fin.

23. The fin of claim 22, wherein the removable stiffening element has different material stiffness characteristics to the body.

24. The fin of claim 23, wherein the underside of the base portion of the fin has a concave curved profile between leading and trailing edges of the fin to accommodate a convex curve in the underside of the watercraft.

* * * * *